United States Patent [19]

Savage

[11] 4,259,054

[45] Mar. 31, 1981

[54] BRICK PRESS FRAME HAVING PRESTRESSED COLUMNS

[75] Inventor: William T. Savage, Lemont, Ill.

[73] Assignee: Wehr Corporation, Milwaukee, Wis.

[21] Appl. No.: 97,129

[22] Filed: Nov. 26, 1979

Related U.S. Application Data

[63] Continuation-in-part of Ser. No. 966,106, Dec. 4, 1978, abandoned.

[51] Int. Cl.[3] ..... B30B 1/00; B30B 11/00

[52] U.S. Cl. ..... 425/344; 425/406

[58] Field of Search ..... 425/344, 406; 100/214

[56] References Cited

U.S. PATENT DOCUMENTS

| | | | |
|---|---|---|---|
| 1,974,148 | 9/1934 | Byerlein | 100/214 |
| 3,154,006 | 10/1964 | Novak | 100/214 X |
| 3,302,556 | 2/1967 | Durbin | 100/214 |
| 3,465,669 | 9/1969 | Doudet | 100/214 |
| 3,492,696 | 2/1970 | Haller | 425/344 X |
| 3,581,656 | 6/1971 | Pappas | 100/214 |
| 3,643,592 | 2/1972 | Blaser | 100/214 |
| 3,647,332 | 3/1972 | Schmaus | 425/344 X |
| 3,664,784 | 5/1972 | Sibley | 425/344 X |
| 3,724,364 | 4/1973 | Munch et al. | 100/214 |
| 3,783,774 | 1/1974 | Groos et al. | 100/214 |
| 3,891,375 | 6/1975 | Pilewski | 425/344 |
| 4,026,207 | 5/1977 | Gailus et al. | 100/214 |

*Primary Examiner*—J. Howard Flint, Jr.

[57] ABSTRACT

A press is provided for forming articles from compressed refractory material such as bricks, the press including a press bed, a crown spaced from the press bed, and a plurality of prestressed support columns rigidly supporting the press bed and the crown in spaced apart relation. The support columns each include a central tie rod including one end extending through a portion of the press bed and including another end extending through a portion of the crown and rigidly engaging the crown. The support columns also include an outer hollow cylindrical member surrounding the tie rods, one end of each of the hollow cylindrical members being positioned against the upper surface of the bed and the opposite end of each of the hollow cylindrical members engaging a lower portion of the crown. The tie rods are subjected to a tensile force while the outer cylindrical members are simultaneously subjected to a compressive force thereby providing a rigid frame structure and one resistive to twisting. The outer cylindrical members also function to provide supporting columns for a mold table and provide for slidable movement of the mold table between the bed and the yoke. The outer cylindrical members also provide for slidable support of a movable crosshead and facilitate movement of the crosshead toward and away from the mold table.

17 Claims, 10 Drawing Figures

BRICK PRESS FRAME HAVING PRESTRESSED COLUMNS

RELATED APPLICATIONS

This application is a continuation-in-part of U.S. Pat. application Ser. No. 966,106, filed Dec. 4, 1978, and now abandoned.

BACKGROUND OF THE INVENTION

The present invention relates to press apparatus and more particularly to presses used in shaping and compressing refractory material in the manufacture of items such as bricks and the like, and to frame structures for such presses.

Presses used in the forming of bricks and other compressed refractory material products normally require structures which include large moving masses, yet which require accurate alignment of a plurality of movable mold members. Such presses may also be subjected to high twisting moments. Accordingly, it is necessary that the frame structures of such presses be particularly rigid to ensure alignment of the various moving press members despite the forces on the press frame.

Attention is directed to the Byerlein U.S. Pat. No. 1,974,148, issued Sept. 18, 1934; the Doudet U.S. Pat. No. 3,465,669, isued Sept. 9, 1969; the Durbin U.S. Pat. No. 3,302,556, issued Feb. 7, 1967; and the Novak U.S. Pat. No. 3,154,006, issued Oct. 27, 1964. Attention is further directed to the Pappas U.S. Pat. No. 3,581,656, issued June 1, 1971, the Blaser U.S. Pat. No. 3,643,592, issued Feb. 22, 1972; the Munch U.S. Pat. No. 3,724,364, issued Apr. 3, 1973; the Groos U.S. Pat. No. 3,783,774, issued Jan. 8, 1974; and the Gailus et al U.S. Pat. No. 4,026,207, issued May 31, 1977.

SUMMARY OF THE INVENTION

The invention includes a press for compressing articles from refractory material, the press comprising a press bed, a crown spaced from the press bed, and means for supporting the press bed and the crown in spaced apart relation. The supporting means includes a plurality of tie rods, each of the tie rods including opposite ends. One of the opposite ends of each of the tie rods extends through at least a portion of the bed and the other of the opposite ends of the tie rods extends through a portion of the crown. A hollow cylinder surrounds the tie rods, the cylinder including opposite ends, one of the opposite ends being positioned against the bed and the other of the opposite ends of the cylinder being positioned against the crown, the cylinder being subjected to a compressive stress and the tie rod being subjected to a tensile stress.

One of the features of the invention is that the press frame is constructed so as to be particularly rigid and resistive to twisting loads.

Another feature of the invention is the provision in the press of a mold table which is supported by the hollow cylinders for slidable movement thereon between the bed and the crown.

Another feature of the invention is the provision in the press of a crosshead supporting a plunger assembly, the crosshead being supported by the hollow cylinders for slidable movement toward and away from the mold table.

Another feature of the invention is the further provision in the press of a plunger assembly having a plurality of spaced generally parallel plungers which extend downwardly from the crosshead and which are receivable in a plurality of complementary mold cavities to compress refractory material supported in the mold cavities.

Another feature of the invention is the provision in the press of a mold supported by the mold table for slidable movement in the direction of the longitudinal axis of the hollow cylinders, the mold including a plurality of spaced mold cavities each extending vertically and being open at the top and bottom of the mold, and the first plunger assembly supported by the press bed. The first plunger assembly includes a plurality of spaced parallel plungers extending upwardly, the plungers being adapted to be received in the lower portions of the mold cavities, and the second plunger assembly supported by the press crosshead for movement toward and away from the mold. The second plunger assembly includes a plurality of spaced parallel plungers respectively aligned with the plungers of the first plunger assembly and adapted to be received in the mold cavities for compressing refractory material therein.

Various other features and advantages of te invention will be set forth in the following description of the preferred embodiment and in the claims.

Figure 1:
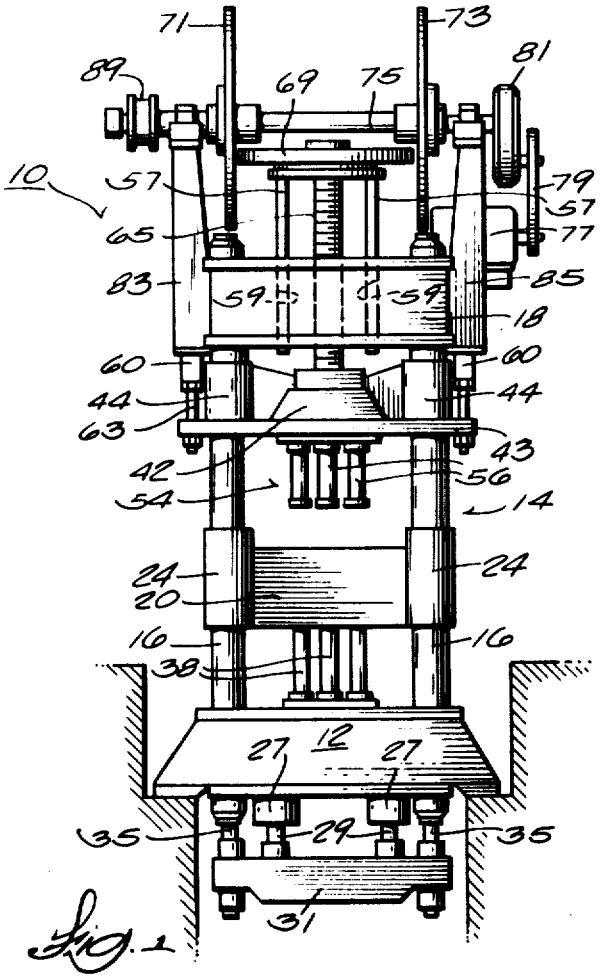
FIG. 1 is an elevation view of a brick press embodying the present invention.

Before explaining the invention in detail, it is to be understood that the invention is not limited in its application to the details of construction and the arrangement of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

DESCRIPTION OF THE PREFERRED EMBODIMENT

Illustrated in FIG. 1 is a press 10 for use in compressing refractory material and for forming bricks and other material formed by pressing the refractory material in a mold. The press generally includes a bed 12 functioning as a rigid supporting structure and a frame assembly 14 supported by the rigid bed 12. The frame assembly 14 is comprised of a plurality of parallel prestressed cylindrical support columns 16 and an upper frame member or crown 18 supported in spaced relation from the bed 12 by the prestressed support columns 16.

Figure 2:
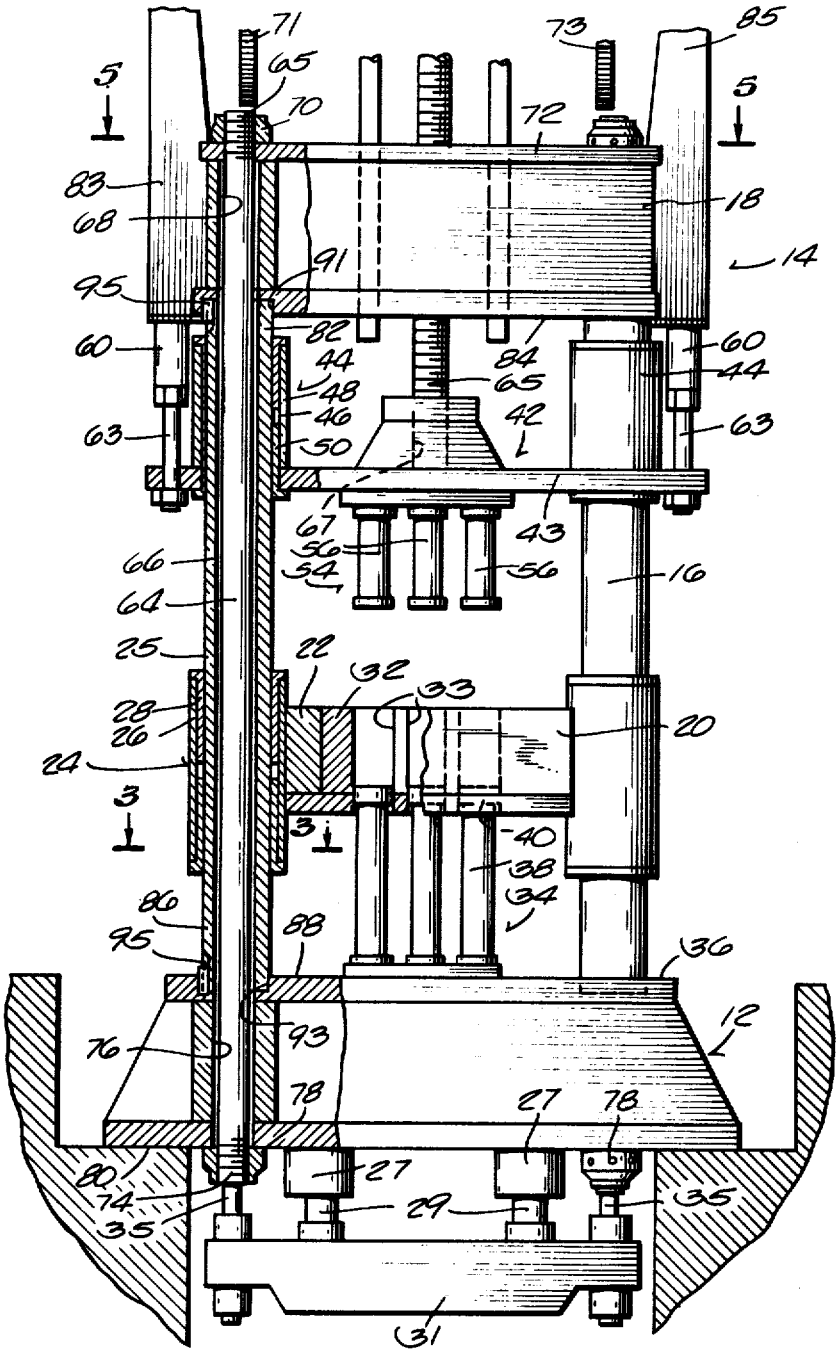
FIG. 2 is an enlarged partial view of the brick press shown in FIG. 1 and with portions shown generally in cross section.

The press 10 further includes a mold table 20 which is slidable on the cylindrical support columns 16 in the direction of their longitudinal axes. The mold table 20 is comprised of a generally rectangular body 22 (FIG. 2) supported at each of its corners by a sleeve 24 supported for slidable movement on the cylindrical support columns 16. More particularly, the sleeves 24 each include an outer tubular portion 26 cast as integral parts of the overall structure of the mold table 20. The sleeves 24 also include a pair of bearing rings 28 and 30 disposed within the outer sleeve 26 and providing for slidable movement of the sleeves 24 on the cylindrical outer surfaces 25 of the support columns 16. Means are also provided for causing vertical movement of the mold table 20 including hydraulic cylinders 27 secured to the bed 12 and housing vertically movable pistons 29. The pistons are connected at their lower ends to a yoke 31. The opposite ends of the yoke 31 support connecting rods 35 extending upwardly through bores in the bed 12 and connected at their upper ends to the mold table 20.

The mold table 20 also includes a central cavity housing a mold 32. In the illustrated construcion, the mold 32 includes a plurality of vertical mold cavities 33 each being open at the top and at the bottom, the mold cavities 33 receiving refractory material therein and having walls providing a forming surface for that refractory material.

The press 10 further includes a plunger assembly 34 supported by the upper surface 36 of the bed 12 and including a plurality of spaced parallel plungers 38 adapted to be received in the mold cavities 33 as shown in FIG. 1 wherein the upper ends 40 of the plungers 38 provide a planar forming surface for supporting refractory material placed in the mold 32.

The press further includes a crosshead 42 supported for slidable movement on the cylindrical support columns 16 and positioned above the mold table 20. The crosshead 42 includes a plurality of supporting sleeves 44 supported for slidable longitudinal movement on the cylindrical surfaces 25 of support columns 16. The crosshead 42 further includes a rigid plate 43 welded or otherwise rigidly secured to the sleeves 44 and between the support columns 16. The press 10 also includes a plunger assembly 54 supported by the plate 52, the plunger assembly 54 including a plurality of spaced downwardly extending plungers 56, the plungers 56 being coaxially aligned with the mold cavities 33 and the plungers 38 of the lower plunger assembly and thereby being adapted to be received in the mold cavities 33 for compressing refractory material therein when the cross head 42 is moved downwardly.

Means are also provided for forcing the crosshead 42 downwardly such that the plungers 56 are received in the mold cavities 33 of the mold 32 to thereby cause compression of refractory material contained in the mold cavities 33 and to thereby form bricks or other products of compressed refractory material. The means for forcing the crosshead 42 downwardly includes a pair of hydraulic cylinders 60 for causing high speed, relatively low force linear movement and a screw assembly 51 for applying compressive force. The hydraulic cylinders 60 are fixedly attached to the crown 18 and include downwardly extending pistons 63 fixed to the crosshead plate 43. The screw assembly 51 includes a large vertical screw 53 extending through a threaded bore in the crown and having a lower end receivable in a bore 67 in the crosshead 42 and adapted to engage the crosshead 42 whereby rotation of the screw 65 will cause a downward force on the crosshead 42. The upper end of the screw 53 supports a horizontally disposed driven wheel 69. The driven wheel 69 is fixed to the screw 53 such that rotation of the driven wheel 69 causes rotation of the screw and consequent vertical movement of the screw with respect to the crown 18. The screw 53 is supported for vertical slideable movement with respect to the crown 18 by a pair of vertical bars 57 slideably supported in bores 59 in the crown and supporting the screw 53.

Means are also provided for selectively and alternatively driving the driven wheel 69 and the screw 53 in clockwise and counterclockwise directions, such means including a pair of mutually spaced flywheels 71 and 73 rotatably driven on a shaft 75 by an electric motor 77, a belt 79, and gear assembly 81. The flywheels 71 and 73 and the shaft 75 are rotatably supported on a pair of mounts 83 and 85 fixedly attached to the crown 18. The upper ends of the mounts 83 and 85 support bearings (not shown) which are adapted to support the shaft 75 for rotation and for limited axial movement.

Flywheel 71 is supported on one side of the driven wheel 69, and flywheel 73 is supported on an opposite side of the driven wheel 69. The shaft 75 is linearly movable from a position wherein one of the flywheels engages the driven wheel 69, to a neutral position wherein neither flywheel engages the driven wheel, to a third position wherein the other flywheel engages the driven wheel. In the first driving position, the rotation of the flywheel 71 will drive the driven wheel 69 and the screw 53 in a first rotational direction for thereby causing vertical movement of the crosshead 42 in a first direction and in the second driving position, the other flywheel 73 will drive the driven wheel 69 and the screw 53 in a reverse rotational direction for causing vertical movement of the crosshead 42 in the other vertical direction.

The means for causing reciprocal movement of the shaft 75 includes an air clutch cylinder 89 fixedly supported by the mount 83 and including a pneumatically driven piston arranged to cause linear reciprocal movement of the shaft 75.

As will be recognized by those skilled in the art, the frame structure of a brick press such as that illustrated is subjected to heavy loads due to the high operating pressures required to compress the refractory material in the mold cavities 33 and due to the large moving masses of the mold table 20 and the crosshead 42. Additionally, the screw assembly employed for driving the upper plunger assembly downwardly, generates a torque on the crown 18 and the upper portions of the press during the compression of the refractory material thereby tending to cause bending of the columns. Furthermore, very accurate tolerances must be maintained to provide for accurate alignment of the mold table 20, the plunger assembly 34 and the plunger assembly 54 to facilitate slideable movement of the press parts and to insure accurate alignment of each of the plungers 38 and 56 with the respective mold cavities 33. Accordingly, it is necessary that the structure forming the frame assembly 14 of the press 10 be particularly rigid and resist torque. It is also particularly important for the support columns 16 to be respectively properly aligned in parallel relationship to facilitiate free sliding movement of both the mold table 20 and the yoke 42 without binding and to prevent undue wear of these moving structures.

To provide for such structural rigidity, the support columns 16 each include a central tie rod 64 extending between the bed 12 and the yoke 18, the central tie rod 64 being subjected to a tensile force as will be described hereinafter and exerting a downward force on the yoke 18. The suppot columns 16 also include an outer hollow cylinder 66 surrounding the tie rod 64, the hollow cylinder being disposed between the bed 12 and the yoke 18 and being subjected to a compressive stress complementary to the tensile stress in the tie rod 64.

Each of the tie rods 64 includes an upper threaded end 65 extending through a bore 68 in the yoke 18. The bores 68 are located at the four corners of the yoke 18. A nut 70 threadably engages the threaded upper end 65 of the tie rod 64 and is received against the upper surface 72 of the yoke 18. A threaded lower end 74 of each of the tie rods 64 extends through a bore 76 in the bed 12 and supports a nut 78 engaging a lower surface portion 80 of bed 12. The upper ends of each of the hollow cylinders 66 surrounding the tie rods 64 are located in countersunk bores 91 in the lower surface portion 84 of the yoke 18, and the lower ends 86 of each of the hollow cylinders 66 are located in countersunk bores 93 in an upper surface portion 88 of the bed 12. The upper and lower ends of the cylinders 66 are prevented from rotation in the countersunk bores 91 and 93 by keys 95.

In operation, when the nuts 70 and 78 engaging the threaded ends of the tie rods 64 are tightened against surfaces 72 and 80, respectively, the yoke 18 and the bed 12 are caused to apply a compressive stress on the hollow cylinders 66 and to apply a tensile stress on the tie rods 64. The combined tensile stress in the tie rods 64 and the compressive stress in the columns 66 functions to cause the support columns to be prestressed and to provide a uniquely rigid supporting frame for the press 10 precluding any shifting or misalignment of the components of the press.

Figure 4:
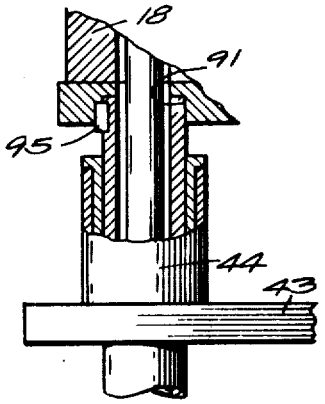
FIG. 4 is a partial view of the apparatus shown in FIG. 2.
Figure 4:
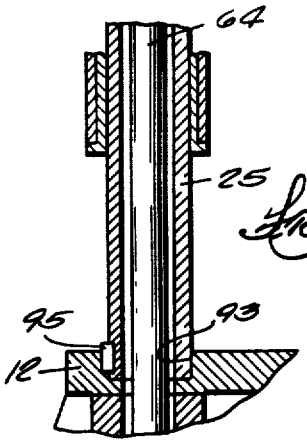
Figure 3:
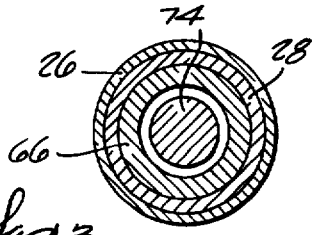
FIG. 3 is a cross section view taken along line 3—3 in FIG. 2.
Figure 8:
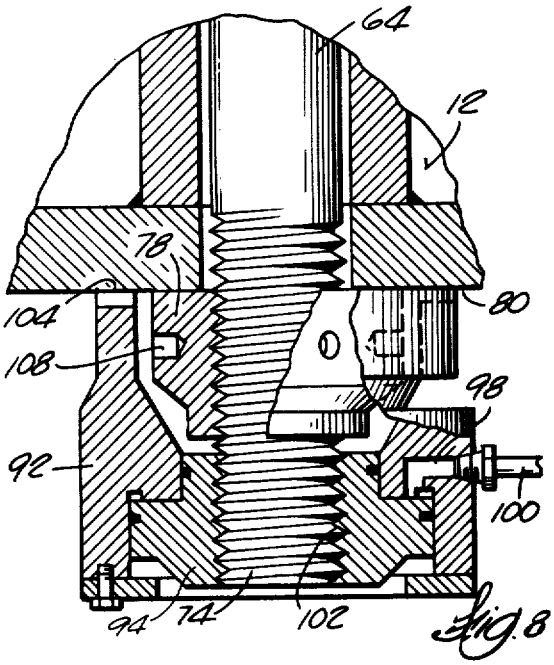
FIGS. 8 and 9 are enlarged views of the end of one of the tie rods shown in FIG. 2 and illustrating a hydraulic nut assembly attached to the end of the tie rod.
Figure 9:
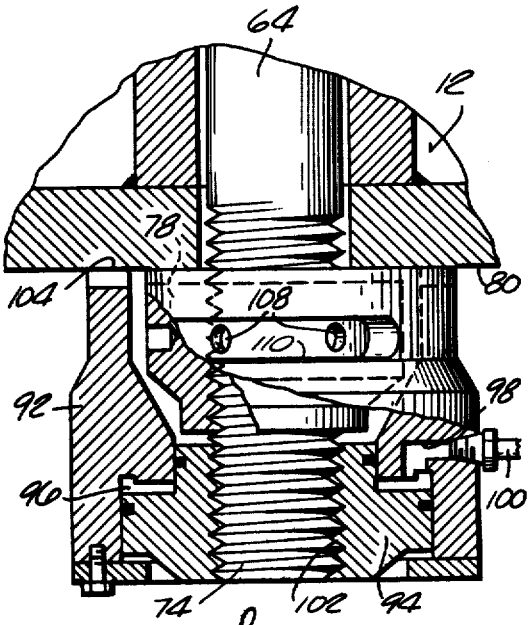
Figure 10:
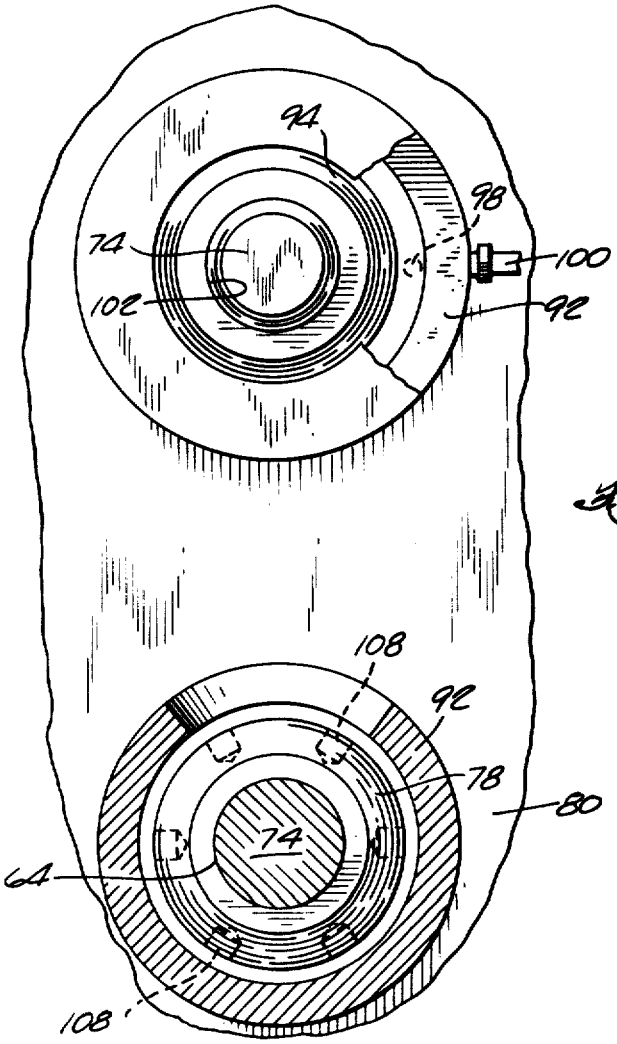
FIG. 10 is a plan view of two of the hydraulic nut assemblies shown in FIGS. 8 and 9 and with portions broken away.

During assembly of the press 10, the requisite tensile stress in the tie rods 64 and compressive stress in the hollow cylinders 66 can be generated by the hydraulic nut assemblies 90 shown in FIGS. 3 and 4. The hydraulic nut assemblies 90 include a hydraulic cylinder 92 having a hydraulic piston 94 therein, the piston 94 being positioned adjacent one end of thecylinder 92 as shown in FIGS. 3 and 4. The piston 94 and cylinder 92 define a fluid chamber 96 therebetween, the fluid chamber 96 being connected through a bore 98 in the cylinder and through a fluid conduit 100 to a source of high pressure hydraulic fluid.

During assembly of the press 10, the nuts 70 may be threaded onto the upper ends 65 of the tie rods 64 and nuts 78 threaded onto the ends 74. Hydraulic nut assemblies 90 are then placed over the nuts 78. The pistons 94 each include a central threaded bore 102 which can be threaded onto the end 74 of the tie rod until the end 104 of the cylinder 92 firmly engages the lower surface 80 of the bed 12. Hydraulic fluid can then be forced into the fluid chamber 96, thereby causing movement of the piston 94 away from the lower surface 80 of the bed 12 and consequent elongation of the tie rod 64. Such elongation of the tie rod 64 generates a tensile stress therein and a compressive stress in the cylinders 66. The tie rods 64 can be maintained under tension by tightening the nuts 78 until they are again firmly positioned against the surface 80 of the bed 12. The nuts 78 are each provided with a plurality of circumferentially spaced bores 108 around their periphery. The nuts 78 can be rotated by extending a rod through a slot 110 in the cylinder 92 and into one of the bores 108.

It will be recognized that substantially equal tensile stress can be generated in the tie rods 64 of each of the columns 16 if hydraulic nut assemblies 90 are placed on each of the tie rods 64 simultaneously and if the fluid conduits 100 of the hydraulic nut assemblies are connected to a common hydraulic fluid source (not shown).

Figure 5:
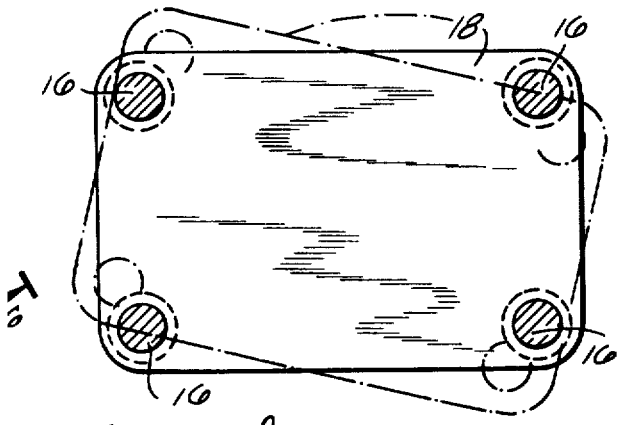
FIG. 5 is a partial plan view taken generally along line 5—5 in FIG. 2.
Figure 7:
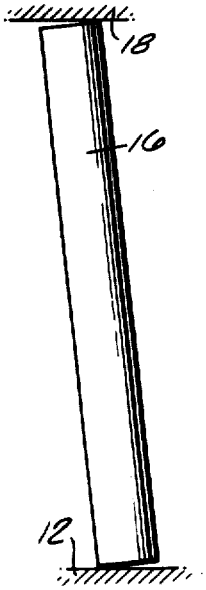
FIG. 7 is a schematic view similar to FIG. 6.
Figure 6:
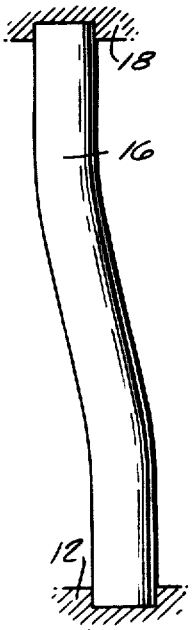
FIG. 6 is a cross section view taken along line 6—6 in FIG. 5.

One of the advantages of the present invention is that the prestressed columns 16 and the means for fixedly attaching the prestressed columns to the press bed 12 and the crown 16 minimize twisting of the press frame 14. In operation of the press, as the upper plunger assembly is driven downwardly and resistance is encountered, the torque on the screw 53 will be transmitted to the crown 18 and the columns 16, thereby tending to cause twisting of the press frame. This torque on the press frame tends to cause movement of the crown 18, as shown in an exaggerated form in FIG. 5, from the solid line position shown therein to the phantom position. If the upper and lower ends of the columns 16 are fixed such that they are rigidly attached to the bed 12 and crown 18 prevented from rotation with respect to the bed and the crown, as is provided by the arrangement of the present invention wherein the tie rods are subjected to a tensile stress and the columns are subjected to compressive stress, the columns behave as if they were integrally joined to the bed and the crown and twisting of the frame requires reverse bending of the columns in the manner illustrated in FIG. 6. It will be readily appreciated that such bending is strongly resisted by the columns. On the other hand, if the upper and lower ends of the columns 16 are not fixedly anchored to the bed and the crown, when a torque is applied to the crown, the column 16 will move with respect to the bed and the crown in the manner generally illustrated in FIG. 7 and the resistance to twisting of the frame will be substantially less than that achieved by the construction embodied by the invention. Additionally, the employment of keys 95 to prevent rotation of the columns with respect to the bed and the crown further resists torsion on the crown since a torsion of the crown will apply a torque on the columns and the inherent strength of the columns will resist such torque.

Various features of the invention are set forth in the following claims.

I claim:

1. A press for forming articles from compressed refractory material, the press comprising:

a press bed, a crown spaced from said press bed, means for supporting said press bed and said crown in spaced apart relation, said supporting means including a plurality of tie rods, each of said tie rods having opposite ends, one of said opposite ends extending through at least a portion of said bed and engaging said bed, and the other of said opposite ends extending through at least a portion of said crown and engaging said crown, each of said tie rods being surrounded by an elongated hollow member, said elongated hollow members each including opposite ends, one of said opposite ends being positioned adjacent said bed and the other of said opposite hollow member ends being positioned adjacent said crown, a mold supported by said hollow members between said bed and said crown, said mold including a mold cavity for supporting refractory material therein, a press member supported for movement between a first position and a position wherein said press member compresses refractory material in said mold cavity, means for selectively forcing said press member into compressing engagement with the refractory material in said mold cavity, said means for forcing applying a torque on said crown when said press member compresses the refractory material, and means for subjecting said tie rods to tensile stress and for subjecting said hollow members to compressive stress and for causing said tie rods and said columns to resist twisting of said crown with respect to said bed when said press member compresses the refractory material in said mold cavity.

2. A press as set forth in claim 1 and further including a crosshead supporting said press member, said crosshead being supported by said hollow members for movement toward and away from said mold.

3. A press as set forth in claim 2 wherein said press member comprises a plunger assembly, said plunger assembly including a plurality of spaced, generally parallel plungers extending downwardly from said crosshead for compressing refractory material supported by said mold table.

4. A press as set forth in claim 2 wherein said mold includes a plurality of mold cavities, each of said mold cavities having upper and lower openings, and further including a first plunger assembly supported by said bed and including a plurality of spaced parallel plungers extending upwardly, said plungers being adapted to be received in said mold cavities, and a second plunger assembly supported by said crosshead for movement toward and away from said mold, said second plunger assembly including a plurality of spaced parallel plungers adapted to be received in said mold cavities for compressing the refractory material when said crosshead is moved toward said mold.

5. A press as set forth in claim 1 wherein said opposite tie rod ends are threaded, and wherein said means for subjecting said tie rods to tensile stress includes a nut threadably positioned on one end of one of said tie rods and engaging said crown and a nut threadably positioned on the opposite end of said one of said tie rods and engaging said bed.

6. A press as set forth in claim 1 and further including means for preventing twisting of said hollow members with respect to said bed and said crown.

7. A press as set forth in claim 1 wherein said hollow members each include an upper end and a lower end, said crown includes a lower surface having bores therein, said upper end of said hollow members being fixedly housed in said bores in said crown, said bed includes an upper surface having a plurality of bores therein, said lower ends of said hollow members being fixedly housed in said bores in said bed.

8. A press as set forth in claim 1 wherein said hollow members each include a longitudinal axis and an upper end and a lower end, and further including means for preventing the upper ends of said hollow members from rotating about their longitudinal axes with respect to said crown and means for preventing the lower ends of said hollow members from rotating about their longitudinal axes with respect to said bed.

9. A press for forming articles from compressed refractory material, the press comprising:

a press bed including an upper surface and a lower surface, a crown spaced from said press bed and including an upper surface and a lower surface, means for supporting said press bed and said crown in spaced apart relation, said supporting means including a plurality of tie rods, one of said opposite ends extending through at least a portion of said bed and engaging said bed, and the other of said opposite ends extending through at least a portion of said crown and engaging said crown, and elongated hollow cylindrical members surrounding said tie rods and compressed between said crown lower surface and said bed upper surface, a mold supported between said bed and said crown and having at least one cavity for supporting refractory material to be compressed, at least one press member supported for movement from a first position to a refractory material compressing position, means for selectively forcing said press member into compressing engagement with the refractory material in said mold cavity, said means for forcing said press member applying a twisting torque on said crown with respect to said press bed when said press member compresses the refractory material, and means for subjecting said tie rods to tensile stress and for subjecting said hollow cylindrical members to a compressive stress whereby said tie rods and said columns resist twisting of said crown with respect to said bed when said press member compresses the refractory material.

10. A press as set forth in claim 9 and further including a mold table supported by said hollow members between said bed and said crown, said mold table supporting said mold and being slidably supported for movement toward and away from said bed.

11. A press as set forth in claim 10 and further including a crosshead supported by said hollow members for movement toward and away from said mold table, said crosshead supporting said press member.

12. A press as set forth in claim 11 and wherein said press member comprises a plunger assembly supported by said crosshead, said plunger assembly including a plurality of spaced, generally parallel plungers extending downwardly from said crosshead for compressing refractory material supported by said mold table.

13. A press as set forth in claim 11 and further including a mold table supported for slideable movement on said hollow cylindrical members, said mold table supporting said mold, and wherein said mold includes a plurality of mold cavities, each of said mold cavities having upper and lower openings, a first plunger assembly supported by said bed and including a plurality of spaced parallel plungers extending upwardly, said plungers being adapted to be received in said mold cavity, and wherein said press member comprises a second plunger assembly supported by said crosshead for movement toward and away from said mold, said second plunger assembly including a plurality of spaced parallel plungers adapted to be received in said mold cavities for compressing the refractory material when said crosshead is moved toward said mold.

14. A press as set forth in claim 9 wherein said means for subjecting said tie rods to tensile stress and for subjecting said hollow cylindrical members to compressive stress includes nuts threadably supported on said tie rod opposite ends and wherein said means for subjecting said tie rods to tensile stress and said hollow cylindrical members to compressive stress further includes hydraulically actuated means associated with the nuts on the ends of said tie rods adjacent said bed lower surface for applying an elongating force to said tie rods after said nuts thereon have been initially seated so that said nuts can be subsequently re-seated to maintain said tie rods in the elongated condition resulting from said elongating force.

15. A press as set forth in claim 9 and further including means for preventing twisting of said hollow cylindrical members with respect to said bed and said crown.

16. A press as set forth in claim 9 wherein said hollow cylindrical members each include an upper end and a lower end, said crown includes a lower surface having bores therein, said upper end of said hollow cylindrical members being fixedly housed in said bores in said crown, said bed includes an upper surface having a plurality of bores therein, said lower ends of said hollow cylindrical members being fixedly housed in said bores in said bed.

17. A press as set forth in claim 9 wherein said hollow cylindrical members each include a longitudinal axis and an upper end and a lower end, and further including means for preventing the upper ends of said hollow cylindrical members from rotating about their longitudinal axes with respect to said crown and means for preventing the lower ends of said hollow cylindrical members from rotating about their longitudinal axes with respect to said bed.

* * * * *